US008622200B2

(12) United States Patent
Prati

(10) Patent No.: US 8,622,200 B2
(45) Date of Patent: Jan. 7, 2014

(54) FEEDING DEVICE WITH MOTORIZED ROLLERS FOR OVERLYING BANDS OF PAPER OR OTHER MATERIALS

(75) Inventor: Pietro Prati, Marradi (IT)

(73) Assignee: Prati S.R.L., Marradi (IT)

( * ) Notice: Subject to any disclaimer, the term of this patent is extended or adjusted under 35 U.S.C. 154(b) by 0 days.

(21) Appl. No.: 13/505,460

(22) PCT Filed: Nov. 1, 2010

(86) PCT No.: PCT/EP2010/066549

§ 371 (c)(1),
(2), (4) Date: May 2, 2012

(87) PCT Pub. No.: WO2011/051485

PCT Pub. Date: May 5, 2011

(65) Prior Publication Data

US 2012/0228091 A1 Sep. 13, 2012

(30) Foreign Application Priority Data

Nov. 2, 2009 (IT) ..... CZ2009A0023

(51) Int. Cl.
*B65G 29/00* (2006.01)

(52) U.S. Cl.
USPC ..... 198/608; 198/623; 198/624

(58) Field of Classification Search
USPC ..... 198/608, 623, 624, 626.1; 226/188, 226/189, 191
See application file for complete search history.

(56) References Cited

U.S. PATENT DOCUMENTS

| | | | | | |
|---|---|---|---|---|---|
| 2,132,785 | A | * | 10/1938 | Hill | 108/165 |
| 2,715,024 | A | * | 8/1955 | Nydegger et al. | 226/191 |
| 2,935,916 | A | * | 5/1960 | Walker | 198/623 |
| 4,403,719 | A | * | 9/1983 | Yamashita | 226/188 |
| 4,678,178 | A | * | 7/1987 | Akiyama et al. | 271/242 |
| 6,082,954 | A | * | 7/2000 | Foster | 414/416.05 |
| 6,102,597 | A | * | 8/2000 | Liberman | 400/636.3 |
| 7,748,520 | B1 | * | 7/2010 | Helgerson et al. | 198/781.03 |
| 8,360,231 | B2 | * | 1/2013 | Yamamoto | 198/623 |

* cited by examiner

*Primary Examiner* — James R Bidwell
(74) *Attorney, Agent, or Firm* — Mark M. Friedman

(57) ABSTRACT

Feeding device, for feeding bands having different lengths and bound in a direction transverse to the feeding direction, includes a driving roller and a rubber-covered pressure roller, both being activated by respective brushless motors. The feeding device is controlled by an electronic drive that allows the pressure roller to rotate at a greater speed than the driving roller, allowing the sliding of the overlapping band above the base band during feed motion, maintaining constant the required tension and eliminating the rolling up of the overlaying band in correspondence of the transversal bind with the base band.

5 Claims, 2 Drawing Sheets

FEEDING DEVICE WITH MOTORIZED ROLLERS FOR OVERLYING BANDS OF PAPER OR OTHER MATERIALS

TECHNICAL FIELD OF THE INVENTION

The present invention concerns a feeding device with motorized rollers for overlying bands (two or more than two), of paper or not, with a different length and bound between them in a transversal sense, constituted of a driving roller and a pressure roller, eliminating the twisting of the upper band or bands in correspondence with the final point of transversal bonding with respect to the sense of advancement, in that inside the two points (initial and final) of transversal bonding, with the extension of the upper part being greater than that of the lower (base) part, a greater running speed is necessary than for that at the lower base.

STATE OF THE ART

To pull material in the form of a band, use is made of a feeding device which, normally, is composed of two rollers held in contact between them and connected to a motorized system; there are various methods relative to the creation of such devices:

A) a main roller R1, usually of metal, connected to the transmission (mechanical or electro-mechanical) and a neutral pressure roller R2 covered with an elastic material (rubber), which turns only through contact with the band (see FIG. 2*a*).

B) a main roller R1, usually of metal, connected to the transmission (mechanical or electro-mechanical) and the pressure roller R2 covered with an elastic material (rubber) connected by driving means to the main roller R1. One of such devices is described in GB-771687. Said device has the disadvantage that, in the presence of bands one overlying the other, of different lengths and bound in a transversal direction between them, the twisting of the upper band or bands takes place in correspondence with the lower base band (see FIG. 2*b*).

C) U.S. Pat. No. 2,715,024 describes a driving roller from a rubber pressure material or anyway a relatively soft material (the upper roller in FIG. 1) and a pressure roller (the lower roller in FIG. 1). Both the upper and lower rollers of the device are driven, namely by the meshing gear (23, 24) in FIG. 2.

SUMMARY OF THE INVENTION

To avoid the twisting of the upper band or bands in correspondence with the transversal binding point with the lower base band, the present invention utilizes two independent brushless motors that are driven by an electronic driving means which adapts the speed of the pressure roller by acting on a second motor connected to said pressure roller.

The invention is therefore created, preferably but not exclusively, by a feeding device with motorized rollers for bands of paper or other materials, one overlying the other, of different lengths and bound in a transversal direction between them, constituted of a driving roller and of a pressure roller, wherein the feeding roller is driven by a first brushless motor and by the fact that the pressure roller is driven by a second brushless motor, characterised by the fact that said feeding device is driven by an electronic driving means that permits the pressure roller to turn at a greater speed than the driving roller, according to as much as is allowed by the bands, one overlying the other, of interposing material, permitting the movement of the overlying band placed above the lower base band during the advance feed, maintaining the necessary tension constant and eliminating the twisting of the overlying band or bands in correspondence with the transversal bonding with the lower base band.

Another characteristic is given by the fact that the electronic driving means that controls the first brushless motor connected to the main driving roller allows the operator to determine the speed and the power with which to make the lower base band advance, maintaining it as constant during the working cycle, and that the electronic driving means that controls the second brushless motor connected to the rubber-covered pressure roller allows the operator to determine and maintain as constant the power necessary so that the rubber-covered pressure roller has the possibility of turning at a higher peripheral speed than the speed of advance feed of the lower base band, said difference being determined and controlled by the sliding of the quantity of excess upper band with respect to that of the lower base band.

Another characteristic is given by the fact that the power assigned to the second brushless motor is determined by the operator on the basis of the dimensions and characteristics of the material being worked.

Another characteristic is given by the fact that the first brushless motor connected to the driving roller is controlled under a given tension at the maximum torque, determining the speed of rotation of the same roller and, therefore, the speed of advancement of the lower base band being worked.

Another characteristic is given by the fact that the second brushless motor connected to the pressure roller is controlled under a given current, this permitting the same to turn at any speed from zero to its permitted maximum, with the possibility of regulating the torque necessary for each single phase of work.

Other characteristics and advantages of the invention will appear clear from the description, here following, of a method of creation, given by the illustrations as a non-limiting example.

DETAILED DESCRIPTION OF AN EMBODIMENT OF THE INVENTION

Figure 1:
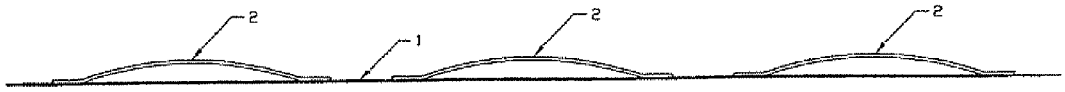
FIG. 1 represents a section of two bands, one overlying the other, that are used by a feeding device, according to the present invention.
Figure 2A:
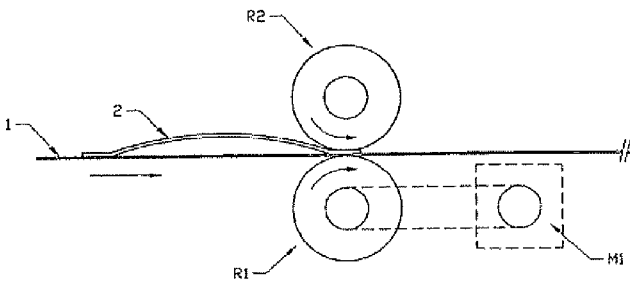
Fig. 2a prior art
FIG. 2*a* represents a section of a feeding device for bands, one overlying the other, in the state of the art.
Figure 2B:
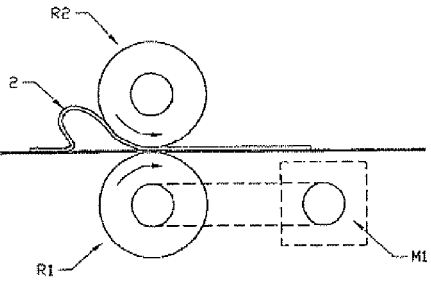
Fig. 2b prior art
FIG. 2*b* represents a section of a feeding device for bands, one overlying the other, in the state of the art.
Figure 3:
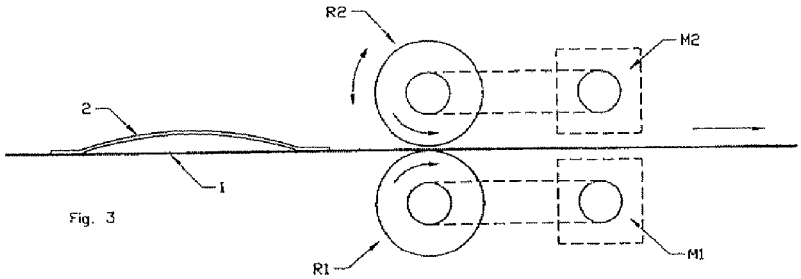
FIG. 3 represents a section of the feeding device for bands, one overlying the other, subject of the present invention.
Figure 4A:
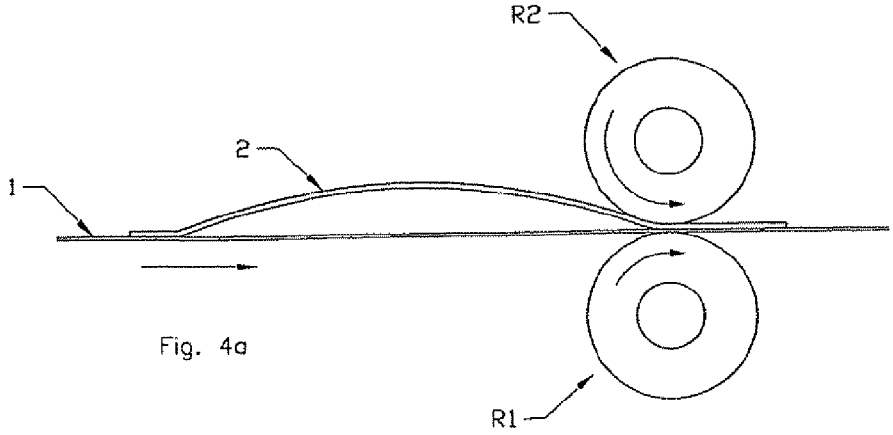
FIG. 4*a* represents a section of a feeding device for bands, one overlying the other, subject of the present invention, before passing onto the overlying band.
Figure 4B:
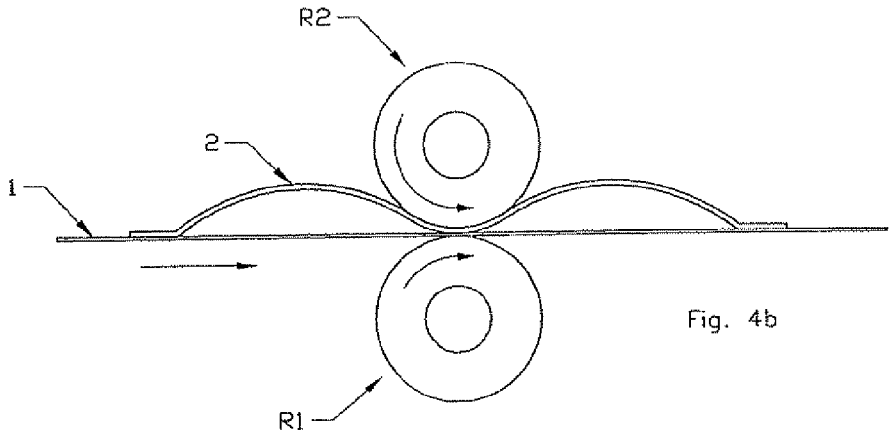
FIG. 4*b* represents a section of a feeding device for bands, one overlying the other, subject of the present invention, while it passes onto the overlying band.
Figure 4C:
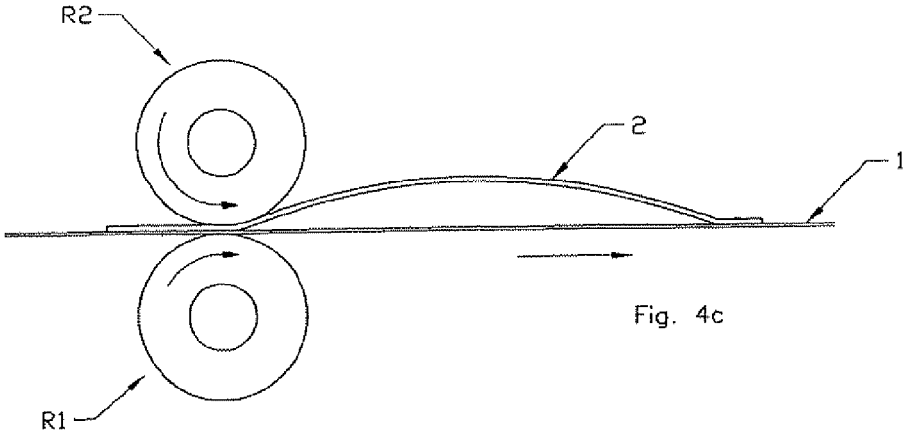
FIG. 4*c* represents a section of a feeding device for bands, one overlying the other, subject of the present invention, after it has passed onto the overlying band.

Two or more overlaying bands of paper or other material, in order to be pulled in a printing machine, or in order to be wound on a roller, or in order to be unwound by a roller, need to be drawn by a feeding device. The bands one overlying the other are constituted of at least a band 1 and by a band 2 that have different lengths and are bound in a transversal sense between them, see FIG. 1.

With reference to FIGS. 3, 4*a*, 4*b* and 4*c*, the feeding device is formed by:

a) a main metal roller R1, directly connected to a first brushless motor M1, that has the functions of feeding and the control of the speed of advancement of the band;

b) a pressure roller R2 covered with an elastic material (rubber) and which is also connected to a second brushless motor M2, with the function of free speed of rotation and variable torque, that adapts its rotation on the basis of as much as is permitted by the band itself, generating the running of the longer upper band, keeping it parallel to the lower base band.

The feeding device, controlled by an electronic driving means, allows the (rubber-covered) pressure roller to turn at a greater speed than the main roller, on the basis of as much as is permitted by the bands of interposing material, allowing the running of the upper band above the lower base band during advancement, maintaining as constant the required tension and eliminating the twisting of the upper band or bands in correspondence with the transversal binding with the lower base band.

The electronic driving means that controls the first brushless motor M1 connected to the main driving roller R1 allows the operator to determine the speed and the power with which to make the base band 1 advance, keeping it constant during the working cycle.

The electronic driving means that controls the second brushless motor M2 connected to the rubber-covered pressure roller R2 allows the operator to determine and keep constant the power necessary so that the rubber-covered pressure roller has the possibility of turning at a higher peripheral speed than the speed of advancement of the lower base band, said difference being determined and controlled by the sliding of the excess quantity of the upper band with respect to that of the lower base band. The power given to the second brushless motor M2 is determined by the operator on the basis of the dimensions and characteristics of the material being worked.

The first brushless motor M1, connected to the driving roller R1, is controlled under a given tension at the maximum torque, determining the speed of rotation of the same roller and thus the speed of advancement of the lower base band 1 being worked.

The second brushless motor M2 connected to the (rubber-covered) pressure roller R2 is controlled by a given current, and this permits the same to turn at any speed from zero to its maximum permitted, with the possibility of regulating the torque necessary for each single phase of work. In this way, the (rubber-covered) pressure roller determines the tension and the running speed of the upper band 2, keeping it equal to that of the lower base band 1.

The invention claim is:

1. Feeding device for feeding bands of materials including a lower base band (1) and an overlying band (2) that is longer than the lower base band and that is bound at both ends thereof to the lower base band in a direction transverse to a direction in which the bands are fed, the feeding device comprising a driving roller (R1) and a rubber pressure roller (R2), wherein the driving roller (R1) is driven by a first brushless motor (M1) and the pressure roller (R2) is driven by a second brushless motor (R2), said feeding device being driven by an electronic driving means that permits the pressure roller (R2) to turn at a greater speed than the driving roller (R1), permitting the movement of the overlying band (2) placed above the lower base band (1) during the advance feed, maintaining the necessary tension constant and eliminating the twisting of the overlying band in correspondence with the transversal bonding with the lower base band.

2. Feeding device according to claim 1, wherein the electronic driving means that controls the first brushless motor (M1) connected to the driving roller (R1) allows the operator to determine the speed and the power with which to make the lower base band (1) advance, maintaining said speed and said power substantially constant during the working cycle, and that the electronic driving means that controls the second brushless motor (M2) connected to the pressure roller (R2) allows an operator of the feeding device to determine and maintain the power necessary so that the pressure roller turns at a higher peripheral speed than the speed of advance feed of the lower base band, in accordance with the sliding of the quantity of excess overlying band with respect to that of the lower base band.

3. Feeding device according to claim 2, wherein the power of the second brushless motor (M2), that turns the pressure roller at said higher peripheral speed, is determined by the operator on the basis of the dimensions and characteristics of the material being worked.

4. Feeding device according to claim 3, wherein the first brushless motor (M1) connected to the driving roller (R1) is controlled under a given tension at a maximum torque, determining the speed of rotation of the driving roller and, therefore, the speed of advancement of the lower base band being worked.

5. Feeding device according to claim 3, wherein the second brushless motor (M2) connected to the pressure roller (R2) is controlled under a given current, this permitting the pressure roller to turn at any speed from zero to its permitted maximum, so as to regulate the torque necessary for each single phase of work.

* * * * *